United States Patent [19]

Fuller et al.

[11] Patent Number: 4,559,478

[45] Date of Patent: Dec. 17, 1985

[54] FLUORESCENT LAMP CIRCUIT

[75] Inventors: Robert P. Fuller, Titusville; Larry A. Nordstrom, Oviedo, both of Fla.

[73] Assignee: U-Lite, Inc., Titusville, Fla.

[21] Appl. No.: 508,680

[22] Filed: Jun. 28, 1983

[51] Int. Cl.[4] ..... H05B 41/24

[52] U.S. Cl. ..... 315/224; 315/219; 315/106; 315/DIG. 7; 363/19; 363/21; 363/131; 339/50 S

[58] Field of Search ..... 315/106, 224, 219, 107, 315/DIG. 7; 363/97, 109, 18–21, 131; 339/50 S

[56] References Cited

U.S. PATENT DOCUMENTS

| | | | |
|---|---|---|---|
| 1,951,113 | 3/1934 | Wiegand | 339/50 S |
| 3,629,648 | 12/1971 | Brown et al. | 315/DIG. 7 X |
| 3,720,861 | 3/1973 | Kahanic | 315/107 X |
| 4,071,807 | 1/1978 | Ichinose | 315/219 |
| 4,234,823 | 11/1980 | Charlot | 315/107 X |
| 4,257,088 | 3/1981 | Nilssen | 363/18 |

FOREIGN PATENT DOCUMENTS

| | | | |
|---|---|---|---|
| 2644664 | 4/1978 | Fed. Rep. of Germany | 339/50 S |

*Primary Examiner*—David K. Moore
*Assistant Examiner*—Vincent DeLuca

[57] ABSTRACT

A d.c.-a.c. inverter circuit allows a standard type fluorescent lamp to be operated from a low-voltage source of d.c. power with a high degree of efficiency attributable in part to use of lamp current as base drive current for a power transistor controlling the energization of a transformer primary winding having two mutually connected secondary windings which apply voltages across the lamp through the power transistor. Additional efficiency is achieved by use of a second transistor under time delay control for supplying preheat current to the lamp and turn-on current to the power transistor only during the starting phase of lamp operation.

15 Claims, 3 Drawing Figures

FLUORESCENT LAMP CIRCUIT

BACKGROUND OF THE INVENTION

The present invention relates to d.c. - a.c. inverter circuitry connectible at its input to a d.c. power source and at its output to a fluorescent lamp. More particularly, it relates to such circuitry that enables a standard type of fluorescent lamp to be operated from a low voltage battery with a high degree of efficiency, i.e., with minimum electrical power input for a given level of light power output.

There are many applications where it is desirable to have a light source that is capable of operating from a convenient d.c. power source, such as a battery. The incandescent lamp is often used as a means of converting electrical power from a battery into light power (illumination). It is well known in the art, however, that an incandescent lamp is a very inefficient means of converting electrical energy into visible light. Approximately 6% of the electrical energy supplied to an incandescent lamp is converted into visible light, the other 94% being used up in the generation of heat with a small accompanying amount of invisible ultraviolet light.

When the supply of electrical energy is limited, as in the case of a battery-operated lamp, it is desirable to achieve maximum operating efficiency so that the lamp can be operated for the longest period of time before the supply of electrical energy is exhausted. It is also well known in the art that a fluorescent lamp is approximately four to five times more efficient than an incandescent lamp. Because of its higher efficiency, the fluorescent lamp has the potential to out-perform the incandescent lamp in those instances where efficiency ranks as an important operating parameter. In order to take full advantage of this remarkable potential, however, it is essential that transistor circuitry used to supply power to the fluorescent lamp does not itself operate inefficiently. To this end, it has heretofore been recognized that the circuitry should at least take into account that the gas mixture in a fluorescent lamp must first become highly ionized in order to cause the lamp to emit visible light, that the application across the lamp of an a.c. voltage rather than a d.c. voltage makes it possible to use a purely reactive element as a current limiting impedance (ballast) in order to minimize energy loss relative to the loss experienced with the use of a resistive ballast, and that the lamp impedance will remain fairly constant if the frequency of the a.c. voltage applied across the lamp has a period of oscillation shorter than the average recombination period of the positive and negative ions, yet not so short as to unduly reduce the effectiveness of transistor switching. It has moreover been recognized that heating at least one cathode in the lamp just prior to or while the starting voltage is being applied will facilitate the ionization process.

SUMMARY OF THE INVENTION

It is the principal aim of the invention to provide transistorized circuitry which functions to convert power from a d.c. power source into a.c. voltages and currents particularly well-suited for operating a standard type fluorescent lamp at optimal efficiency.

Another aim of the invention is to provide such aforesaid circuitry with the function also of supplying transient voltages and currents only during the initial ionization of the lamp, these transients going to zero once the lamp has been started, thereby contributing to overall efficiency.

A further aim of the invention is to provide either of the aforesaid circuitries with a power transistor arranged so that current in the lamp also flows through the base of the power transistor causing the base drive to the transistor to be self-regulating, thereby contributing to overall efficiency.

According to one aspect of the invention, there is provided a fluorescent lamp circuit comprising:

(a) a fluorescent lamp of the type having a preheater which serves also as one of two spaced electrodes between which arcing in the gas filling of the lamp is to be initiated to ionize the gas filling with the aid of free electrons thermionically emitted therein by said preheater;

(b) a first sub-circuit for driving current through said preheater; and (c) a second sub-circuit for driving current through said lamp between said spaced electrodes once the operation of said second sub-circuit has been started by a turn-on current supplied thereto;

(d) said first sub-circuit being arranged to commence energization of said preheater and continue such energization only for a time period of limited duration from a low-voltage d.c. power source upon a connection being made of said lamp circuit to said source, said first sub-circuit being further arranged to supply turn-on current during said period to said second sub-circuit sufficient to start its operation;

(e) said second sub-circuit, upon having its operation started, being arranged to operate thereafter as an inverter energized by said d.c. power source to drive high frequency alternating starting current through said lamp via said electrodes to ionize said gas filling within said time period and regeneratively to maintain its said inverter operation at a reduced voltage across said lamp after ionization takes place so as continuously to drive high frequency operating current through said lamp, the operating conditions of said second sub-circuit being self-adjusting in response to said starting and operating currents to compensate for changes in the respective peak values of said currents from predetermined optimally efficient magnitudes.

According to another aspect of the invention, there is provided a fluorescent lamp circuit comprising:

a pair of input terminals for connection across a low voltage d.c. power source;

a fluorescent lamp having a pair of electrodes at opposite ends of a gas-filled envelope;

a transformer having a ferromagnetic core on which a primary winding, a first secondary winding and a second secondary winding are wound, said secondary windings being connected in series with one another in voltage aiding relationship;

a bipolar transistor which, when conductive, connects said primary winding across said pair of input terminals;

first biasing means which, in response to the connecting of said pair of input terminals across said power source, supplies forward driving current through the base of said transistor to cause said transistor to become partially conductive so that current from said power source begins to flow through said primary winding;

means connecting one side of the serially-connected secondary windings to one end electrode of said fluorescent lamp and the other side through the base of said transistor via the path of said forward driving current thereof to the other end electrode;

a diode connected across said forward driving current path of said transistor in anti-polarity relationship therewith; and a resistor connected from a common connection point of said serially-connected secondary windings to a common connection point of said diode, said forward driving current path of said transistor and one of said pair of input terminals;

said resistor, diode, secondary windings and the impedance of said fluorescent lamp providing biasing conditions for said transistor which cause the conductivity of said transistor to undergo successive time cycles upon said pair of input terminals being connected across said power source, one half period of each time cycle being characterized by a rise and fall of transistor conductivity from zero to full and back to zero, and the other half period by a continuing zero conductivity, each cycle being initiated by said first biasing means at least during the first few seconds of operation, whereby voltages of one polarity are induced across said secondary windings by said primary winding to drive current of one direction through said fluorescent lamp via the base of said transistor as said transistor experiences its conductive half cycle, and voltages of opposite polarity to said one polarity develop across said secondary windings to drive current of the opposite direction through said fluorescent lamp via said diode as said transistor experiences its non-conductive half cycle, the flow of lamp current via the base of said transistor effecting an automatic adjustment of the transistor base drive to regulate said lamp current.

According to a further aspect of the invention, the fluorescent lamp circuit is combined with a housing comprising:

(a) a hollow tubular body of light-transmissive rigid material in which the fluorescent lamp of said lamp circuit is centrally disposed with peripheral clearance thereabout, the length of said tubular body exceeding the length of said fluorescent lamp so that opposite end portions of said tubular body are left unoccupied by said fluorescent lamp, one such end portion containing the first and second sub-circuits of said lamp circuit in a common protective encapsulation from which electrical output leads of said sub-circuits emerge and connect to terminal pins provided at the ends of said fluorescent lamp for the driving currents to be supplied by said sub-circuits;

(b) first and second cup-like end caps of elastomeric material removably cupped over said one end portion and the other end portion, respectively, of said tubular body, each with a watertight interference fit, said first end cap having a passage extending through its base from its cup chamber to the surrounding atmosphere; and (c) an elongated two-conductor cable having one end thereof electrically connected within said cup chamber to electrical input connections of said first and second sub-circuits emerging from said common protective encapsulation thereof, said cable including a first length portion proximate its said one end and coextensively disposed in said passage so that a relatively longer remaining length portion extends into said surrounding atmosphere to permit electrical connection of the other end of said cable to a remotely-located low-voltage d.c. power source, said cable havng an elastomeric insulating jacket of a cross-sectional shape which complements that of said passage and which, along said first length portion, makes a watertight interference fit with said passage.

BRIEF DESCRIPTION OF THE DRAWINGS

In order that the present invention may be more fully understood, it will now be described with reference to the accompanying drawings, in which.

DESCRIPTION OF THE PREFERRED EMBODIMENTS

Figure 1:
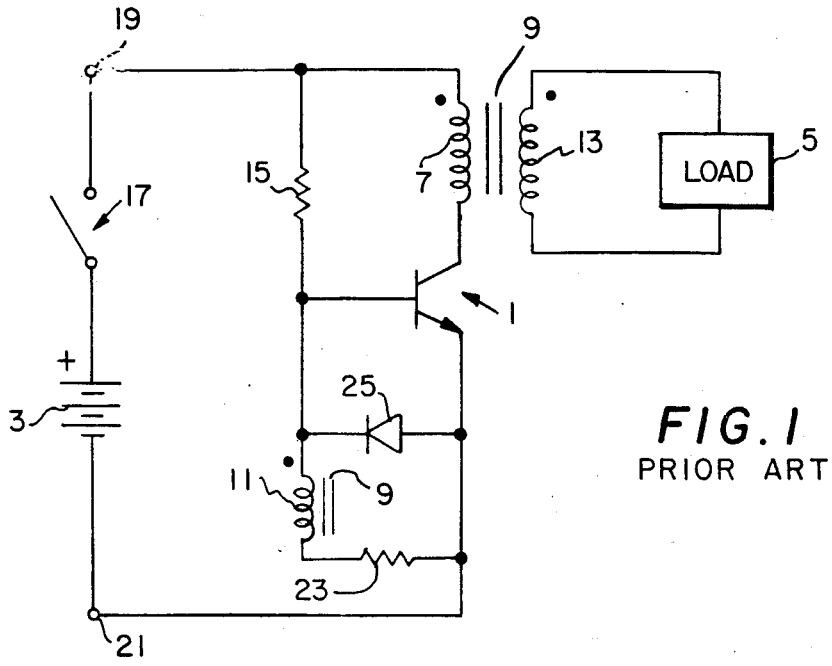
FIG. 1 PRIOR ART
FIG. 1 is a schematic circuit diagram of a prior art fly-back d.c. - a.c. inverter circuit having some features in common with the preferred embodiment of the circuitry according to the invention.

The prior art fly-back d.c.-a.c. inverter depicted in FIG. 1 uses a single bipolar transistor 1 operating from a low voltage battery 3 to power a load 5 which requires a high voltage, low current supply. The emitter-collector path of transistor 1 is connected in series with a transformer primary (or input) winding 7 wound on a first secondary (or hold) winding 11 and a second secondary (or ouput winding 13. Transistor 1 begins to conduct as a result of a forward bias current caused to flow through its base-emitter path by way of a resistor 15 when a main supply switch 17 in a series connection with battery 3 across circuit input terminals 19, 21 is closed. A positive voltage then begins to build up across primary winding 7 and, by induction, across each of secondary windings 11, 13. The voltage induced in first secondary winding 11 causes additional forward bias current to flow through a second resistor 23 and the base-emitter path of transistor 1, thereby rapidly making the transistor fully conductive, i.e. fully ON. Second secondary winding 13 is connected solely across load 5, so that the induced voltage applied to load 5 rises positively with the rise in primary voltage.

Immediately after transistor 1 becomes fully conductive, a slight decrease occurs in the primary voltage due to increased transistor saturation voltage which itself is due to a linearly increasing magnetizing current of the transformer beginning with the conduction of transistor 1. The decreased positive primary voltage is reflected in secondary windings 11, 13; and the decreased voltage across first secondary winding 11 decreases the base drive of transistor 1, resulting in a further increase in the ON resistance of transistor 1. This causes a further decrease in positive primary voltage and, as the process is regenerative, transistor 1 is rapidly turned OFF. Now, due to the inductive natures of windings 7, 11 and 13, the polarities of the winding voltages will reverse. At this time, a negative current will flow through first secondary winding 11, resistor 23 and a diode 25 which is connected in parallel anti-polarity relationship with the base-emitter path of transistor 1, such current providing a back bias which holds transistor 1 in its turned OFF condition. Meanwhile, negative current flowing through secondary winding 13 as a result of the voltage polarity reversal drives the voltage across load 5 to a high peak negative value. This current continues to flow until the energy stored in the magentic field of the transformer while transistor 1 was ON is dissipated in load 5. The negative current in first secondary winding 11 continues to flow in OFF biasing relationship to transistor 1 until such current has become so small that diode 25 ceases to conduct, whereupon forward bias current flowing from battery 3 through resistor 15 and the base-emitter path of transistor 1 again causes the transistor to begin to conduct and the preceeding cycle repeats.

Should load 5 in FIG. 1 be a fluorescent lamp of the preheat type and should provision be made for energizing at least one preheater of the lamp upon connecting the inverter circuit to battery 3, the resulting free electrons thermionically emitted into the gas filling will so lower the lamp impedance that an arc will be struck across the electrode gap of the lamp by one or more of the successive cycles of positive and negative voltages applied across the lamp by second secondary winding 13, whereby the gas filling will become ionized. Although the reactance of second secondary winding 13 will then limit the lamp current in ballast fashion, the inverter circuit will continue to apply across the electrode gap of the lamp high peak voltages which become unnecessary once ionization occurs. The preheater will, moreover, remain energized longer than necessary to facilitate ionization, and biasing current will flow through resistor 15 for starting each cycle as long as main supply switch 17 is closed. All of this adversely affects the overall efficiency of operation as gauged by the electrical power input required for a given level of light power output. These drawbacks are eliminated by certain features of the invention embodied in the circuitry depicted in FIG. 2; and certain additional features of the invention also embodied in such circuitry account for still further improvements in overall efficiency.

Figure 2:
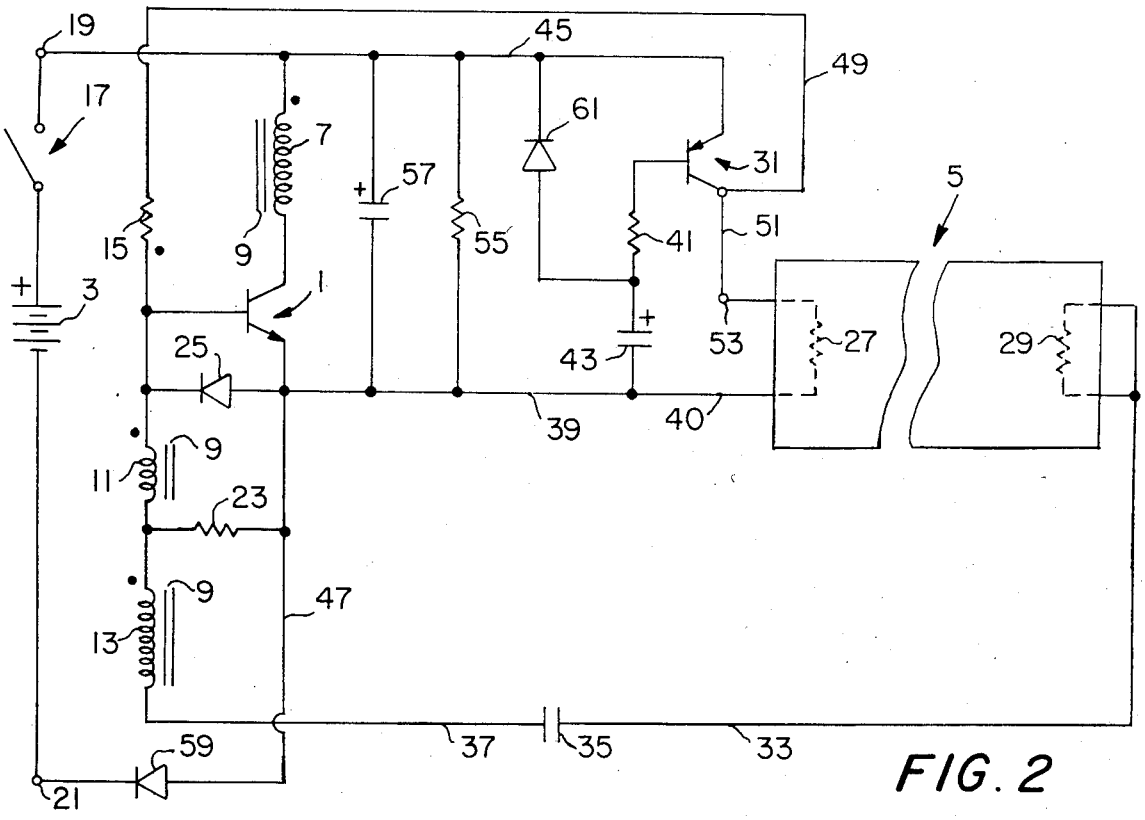
FIG. 2 is a schematic circuit diagram of the preferred embodiment of the circuitry according to the invention.

Referring to FIG. 2, wherein like reference numerals are employed to identify like parts shown in FIG. 1, it is seen that second secondary winding 13 is now electrically connected in series voltage-aiding relationship with first secondary winding 11 so that current driven in one direction through load 5 is also driven through the base of transistor 1. Because of this feature, the base drive to transistor 1 is self-regulating, i.e. increases in load current cause corresponding increases in the base drive current, whereas decreases in load current cause corresponding decreases in base drive current.

In FIG. 2, load 5 is schematically depicted as a conventional fluorescent lamp of the type having resistive preheater filaments at opposite ends which serve also as electrodes 27, 29 between which arcing in the gas filling is to be initiated to ionize the gas filling. Only one of the electrodes, however, need be used in its dual capacity and, to this end, electrode 27 is connected in a series circuit including battery 3, main supply switch 17 and the emitter-collector path of a starting bipolar transistor 31. Current from battery 3 will heat electrode 27 when main supply switch 17 is closed and starting transistor 31 is in a conductive state. On the other hand, the resistive filament of opposite electrode 29 is shunted and, as such, is connected by a conductor 33 to one side of a capacitor 35, the other side of which is connected by a conductor 37 through second secondary winding 13, first second secondary winding 11, the base-emitter path of transistor 1 (or diode 25, depending on the direction of the load current) and a conductor 39 to a terminal 40 of electrode 27 on the negative side of battery 3.

As an efficiency-promoting feature, starting transistor 31 is part of a sub-circuit for driving current through the resistive filament of electrode 27 only for a time period of limited duration starting with the closing of main supply switch 17 and ending about 2 seconds later when full ionization is certain to have occurred in the lamp. To this end, starting transistor 31 has its base-emitter path connected in series with a resistor 41 and capacitor 43, the serially connected base-emitter path, resistor 41 and capacitor 43 being connected by a conductor 45 to input terminal 19 at the positive side of battery 3 and by conductor 39 and a conductor 47 to input terminal 21 at the negative side of battery 3. The closing of main supply switch 17 thereby causes forward biasing current to flow via resistor 41 and capacitor 43 through the base-emitter path of starting transistor 31 to switch the starting transistor ON and maintain its ON state until capacitor 43 becomes fully charged at the end of the aforementioned time period of limited duration.

The sub-circuit of which starting transistor 31 is a part provides another efficiency-promoting feature whereby, over the same time period during which it energizes the resistive heating filament of lamp electrode 27, it supplies turn-on current to the power transistor 1, the latter transistor conveniently being viewable as part of another sub-circuit specifically provided to drive current through load 5 across the gap between electrodes 27, 29. To this end, when starting transistor (31) is conductive, current flows from input terminal 19 via conductor 45 through the emitter-collector path of starting transistor 31, thence via a conductor 49 through resistor 15, the base-emitter path of power transistor 1 and conductor 47 to input terminal 21. Conductor 49 branches off from the emitter-collector path of starting transistor 31 where a connection 51 is made from such path to the other terminal 53 of the resistive heating filament of electrode 27. Current flowing through resistor 15 supplies the base-emitter path of transistor 1 with a forward bias current which constitutes the turn-on current for starting the operation of power transistor 1 and the sub-circuit of which power transistor 1 forms part. Efficiency is promoted by the limited duration of the forward bias current flowing through resistor 15, since such forward bias current is only needed until ionization in the lamp has taken place, whereafter capacitor 35 is capable of supplying the forward bias current required for power transistor 1 during the portion of each cycle where power transistor 1 is required to turn ON. Thus, the current drain placed by resistor 15 on battery 3 in the prior art circuitry of FIG. 1 is eliminated in the circuitry of FIG. 2 about 2 seconds after main supply switch 17 is closed.

It will be appreciated that power transistor 1 repeatedly undergoes successive first and second half-cycles of conductivity, which conductivity rises from 0 in the first-half cycle to provide a rising and falling current from battery 3 through primary winding 7 to induce rising and falling voltages in first and second secondary windings 11, 13 and which, in the second half-cycle, remains at 0 to cause the falling voltages last induced in the secondary windings to reverse in polarity, whereby during each first half-cycle of power transistor conductivity, the secondary winding voltages drive current in one direction through lamp load 5 and during each second half-cycle of power transistor conductivity, the secondary winding voltages drive current in the opposite direction through lamp load 5. Resistor 23 permits a small amount of base drive current to flow in power transistor 1 to keep the sub-circuit of power transistor 1 oscillating while ionization is occuring in lamp-load 5. Capacitor 35 stores energy during the first half-cycle of power transistor conductivity for augmenting the energy stored by the magnetic field of the transformer during the first half-cycle in energizing lamp-load 5 during the second half-cycle of power transistor conductivity.

A parallel resistance-capacitance network 55, 57 is connected across conductors 39, 45, hence across the serially-connected collector-emmitter path of power transistor 1 and primary winding 7 so as to establish a reverse bias on the collector of power transistor 1 immediately upon the closing of main supply switch 17 to connect imput terminals 19, 21 across battery 3.

Core 9, upon which primary winding 7 and secondary windings 11, 13 are wound, is preferably a ferrite slug, and an air gap is formed in the closed magnetic path which causes the transformer to exhibit a gradual saturation of flux density as the magnetic intensity increases.

The period of oscillation of the current driven through lamp-load 5 is shorter than the average recombination period of the positive and negative ions of the ionized gas filling of the load.

The circuit shown in FIG. 2 oscillates at approximately 62 KHZ after full ionization is achieved, the frequency of oscillation being slightly higher prior to full ionization. Particulars of the circuit elements shown in FIG. 2 are as follows:

Resistor 15—270 ohms, ¼ w
Resistor 23—33 ohms, ¼ w
Resistor 41—10.0 Kohms, ¼ w
Resistor 55—3.3 Kohms, ¼ w
Primary winding 7—20 turns, 24 gauge
First secondary winding 11—4 turns, 30 gauge
Second secondary winding 13—350 turns, 30 gauge
Capacitors 43, 57—220 mfd, 16 v
Capacitor 35—0.0022 mfd, 600 v
Power transistor 1—TIP 33C (NPN)
Starting transistor 31—TIP 125 (PNP Darlington)
Transformer core 9—¼" square × 1" long ferrite slug
Battery 3—12 v Conductor 47 includes a diode 59 having its cathode adjacent terminal 21 in order to protect the circuitry from an inadvertent application of a reverse polarity voltage at terminals 19, 21.

It is interesting to note what takes place when the voltage at terminals 19, 21 is reduced, as in the case of a slowly discharging battery 3. As the battery voltage decreases, the circuitry continues to operate satisfactorily until such time as the peak-to-peak voltage across lamp-load 5 is too low to sustain full ionization. At this point, the load impedance increases abruptly. The increased load impedance reduces the peak-to-peak voltage that develops across capacitor 35 during each half-cycle. The decrease in voltage across capacitor 35 will prevent capacitor 35 from providing sufficient base drive to power transistor 1 to initiate a new cycle of operation. Thus, power transistor 1 will remain in its OFF state and the only drain on battery 3 will be the small amount of current flowing through resistor 55, i.e. about 5 ma. The current flow through resistor 55 will drain away any residual charge that remains on capacitor 57 and, through a diode 61 connected between conductor 45 and the common terminal of resistor 41 and capacitor 43, will also drain away any residual charge that remains on capacitor 43. It is desirable to drain away any residual charges on capacitors 43, 57 so that the circuitry will be ready for another start cycle when terminals 19, 20 are applied across a fresh battery.

The large air gap in the closed magnetic path of the transformer, which air gap stems from the use of a ferrite slug as the common core for primary winding 7, first secondary winding 11 and second secondary winding 13, promotes overall efficiency since the magnetizing current does not increase sharply just prior to power transistor 1 turning OFF, as would be the case with square loop type transformer cores.

During the starting operation, while the impedance of lamp-load 5 is high due to initial non-ionization, the load current is relatively small, i.e. less than 50 ma peak, both when power transistor 1 is ON and OFF. However, when power transistor 1 is OFF, the negative current through secondary windings 11, 13 will drive the voltage across lamp-load 5 to approximately −400 v, and the peak-to-peak voltage across capacitor 35 will be relatively small mainly due to the limiting effect of the initial high impedance of lamp-load 5 on the current that can flow into capacitor 35 during each half-cycle. After a fraction of a second, ionization takes place due mainly to the −400 v peaks across lamp-load 5 in conjunction with the thermionic emission of filament electrode 27. The lower impedance associated with ionization causes the load current to increase to about 230 ma peak which causes capacitor 35 to acquire a higher voltage during each half-cycle. The peak voltage across lamp-load 5 when power transistor 1 turns OFF each half-cycle then drops considerably. Thus, during starting, a high peak voltage is applied across lamp-load 5 and filament electrode 27 is heated. The high peak voltage impressed across lamp-load 5 during the starting process automatically adjusts to a lower (more efficient) voltage after ionization takes place, and the heating current goes to zero about 2 seconds after the input voltage is first applied. The load current flows through the base of power transistor 1 and automatically adjusts the base drive current to compensate for changes in load current. The starting current through resistor 15 for power transistor 1 is automatically adjusted to zero about 2 seconds after the input voltage is first applied.

The possible applications of the fluorescent lamp circuitry according to the invention are many. For example, it can be used to provide illumination aboard boats, particularly sailboats, or to provide illumination in motorized campers when no external power hook-up is available, or to provide emergency household illumination during blackouts. However, an especially useful application of the fluorescent lamp circuitry is for night-fishing to attract fish by the illumination it provides. In this respect, it would be used in combination with a watertight housing. Such a combination will now be described with reference to FIG. 3 of the drawings.

Figure 3:
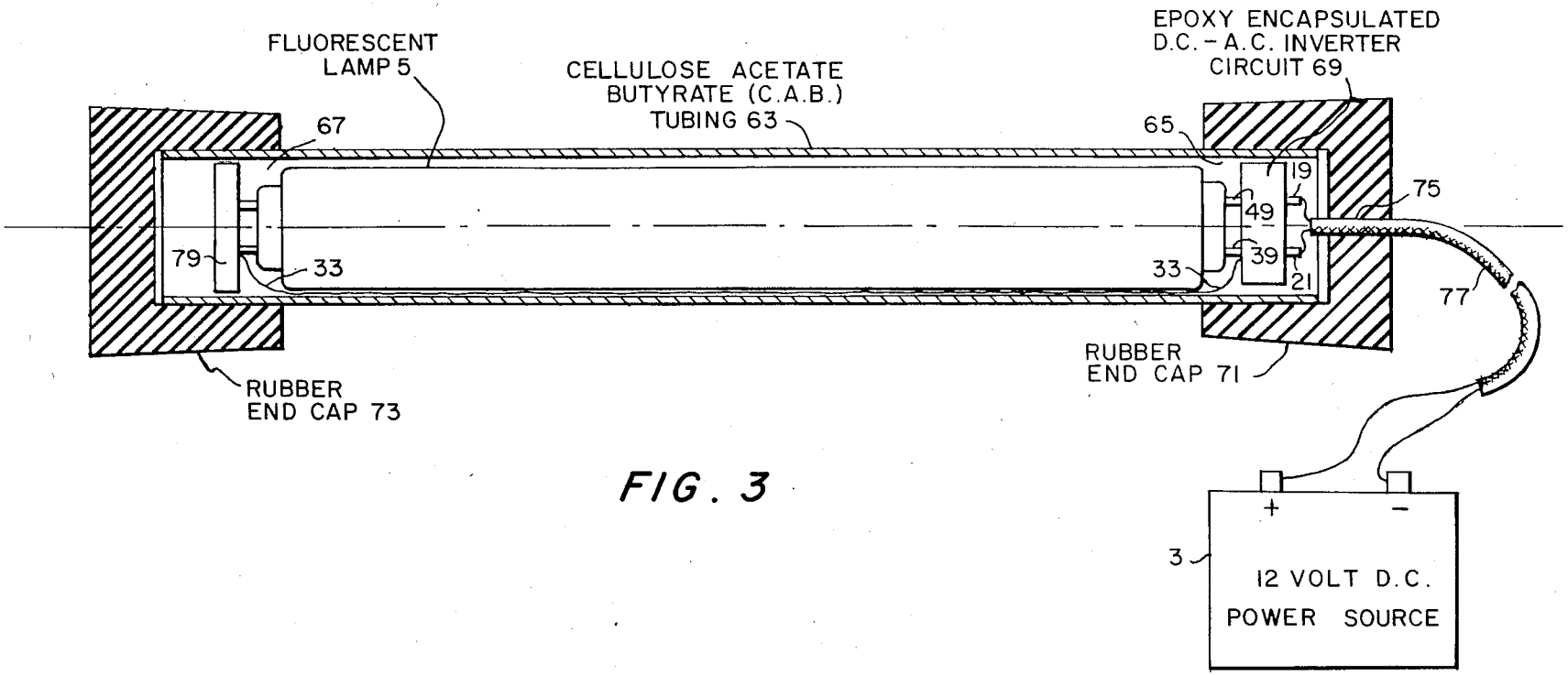
FIG. 3 is a front elevational view in section illustrative of a combination, in accordance with the invention, of a fluorescent lamp circuit with a watertight housing.

In FIG. 3, a hollow tubular body 63 of light-transmissive rigid material, such as cellulose acetate butyrate (C.A.B.) or polycarbonate, is provided in which fluorescent lamp 5 of FIG. 2 is centrally disposed with clearance thereabout. The length of tubular body 63 exceeds the length of lamp 5 so that opposite end portions 65, 67 of the body are left unoccupied by the lamp. One such end portion 65 contains the circuitry of FIG. 2 in a protective encapsulation 69, suitably of epoxy material, from which electrical output leads 33, 39, 49 of the circuitry emerge and connect to the appropriate terminal pins of the lamp.

Similar cup-like end caps 71, 73 of elastomeric material, such as rubber, are removably capped over end portions 65, 67 respectively, each with a watertight interference fit. The outer peripheries of end caps 71, 73 taper inwardly towards the center of the assembly. End cap 65 is provided with a passage 75 extending through its base from its cup chamber to the surrounding atmosphere. An elongated two-conductor cable 77 has one end thereof connected within end cap 71 to electrical input terminals 19, 21 emerging from encapsulation 69. Cable 77 passes out of end cap 71 via passage 75 and has an elastomeric insulating jacket of a cross-sectional shape which complements that of passage 75 and makes a watertight interference fit therewith. The other end of cable 77 is connected to battery 3, switch 17 being omitted for simplification. Within the cup chamber of end cap 73, a suitable support 79, into which the lamp terminal pins are plugged, is provided for the corresponding end of lamp 5.

We claim:

1. A fluorescent lamp circuit comprising:

a pair of input terminals for connection across a low voltage d.c. power source;

a fluorescent lamp having a pair of electrodes at opposite ends of a gas-filled envelope;

a transformer having a ferromagnetic core on which a primary winding, a first secondary winding and a second secondary winding are wound, said secondary windings being connected in series with one another in voltage aiding relationship;

a bipolar transistor which, when conductive, connects said primary winding across said pair of input terminals;

first biasing means which, in response to the connecting of said pair of input terminals across said power source, supplies forward driving current through the base of said transistor to cause said transistor to become partially conductive so that current from said power source begins to flow through said primary winding;

means connecting one side of the serially-connected secondary windings to one end electrode of said fluorescent lamp and the other side through the base of said transistor via the path of said forward driving current thereof to the other end electrode;

a diode connected across said forward driving current path of said transistor in anti-polarity relationship therewith; and a resistor connected from a common connection point of said serially-connected secondary windings to a common connection point of said diode, said forward driving current path of said transistor and one of said pair of input terminals;

said resistor, diode, secondary windings and the impedance of said fluorescent lamp providing biasing conditions for said transistor which cause the conductivity of said transistor to undergo successive time cycles upon said pair of input terminals being connected across said power source, one half period of each time cycle being characterized by a rise and fall of transistor conductivity from zero to full and back to zero, and the other half period by a continuing zero conductivity, each cycle being initiated by said first biasing means at least during the first few seconds of operation, whereby voltages of one polarity are induced across said secondary windings by said primary winding to drive current of one direction through said fluorescent lamp via the base of said transistor as said transistor experiences its conductive half cycle, and voltages of opposite polarity to said one polarity develop across said secondary windings to drive current of the opposite direction through said fluorescent lamp via said diode as said transistor experiences its non-conductive half cycle, the flow of lamp current via the base of said transistor effecting an automatic adjustment of the transistor base drive to regulate said lamp current.

2. A fluorescent lamp circuit according to claim 1, wherein at least one of said electrodes of said fluorescent lamp incorporates an electrically resistive preheater for thermionically emitting free electrons into the gas filling of said lamp to facilitate ionization; and wherein said first biasing means, while supplying said forward driving current through the base of said transistor, is operative also to supply energizing current to said preheater.

3. A fluorescent lamp circuit according to claim 2, wherein said first biasing means includes a second bipolar transistor having one side of its emitter-collector path connected directly to one of said input terminals and the other side thereof to the other input terminal by way of a network in which said preheater is connected across a series connection of a biasing resistor with said forward driving current path of the first-mentioned transistor.

4. A fluorescent lamp circuit according to claim 3, wherein means are connected between the base of said second transistor and said other input terminal which, in response to the connecting of said pair of input terminals across said low voltage d.c. power source, supplies source-derived forward driving current through the base of said second transistor for a limited time period determinatve of the time period during which said first biasing means supplies energizing current to said preheater while also supplying forward driving current through the base of said first-mentioned transistor.

5. A fluorescent lamp circuit according to claim 4, wherein said means connected between the base of said second transistor and said other input terminal comprises a serially connected resistor and capacitor having a time constant slightly exceeding the time required by said lamp circuit to achieve ionization of the gas filling in the lamp envelope, e.g. a time constant of about 2 seconds.

6. A fluorescent lamp circuit according to claim 1 in combination with a watertight housing, said housing comprising:

(a) a hollow tubular body of light-transmissive rigid material in which the fluorescent lamp of said lamp circuit is centrally disposed with peripheral clearance thereabout, the length of said tubular body exceeding the length of said fluorescent lamp so that opposite end portions of said tubular body are left unoccupied by said fluorescent lamp, one such end portion containing the first and second sub-circuits of said lamp circuit in a common protective encapsulation from which electrical output leads of said sub-circuits emerge and connect to terminal pins provided at the ends of said fluorescent lamp for the driving currents to be supplied by said sub-circuits;

(b) first and second cup-like end caps of elastomeric material removably cupped over said one end portion and the other end portion, respectively, of said tubular body, each with a watertight interference fit, said first end cap having a passage extending through its base from its cup chamber to the surrounding atmosphere; and (c) an elongated two-conductor cable having one end thereof electrically connected within said cup chamber to electrical input connections of said first and second sub-circuits emerging from said common protective encapsulation thereof, said cable including a first length portion proximate its said one end and coextensively disposed in said passage so that a relatively longer remaining length portion extends into said surrounding atmosphere to permit electrical connection of the other end of said cable to a remotely-located low-voltage d.c. power source, said cable havng an elastomeric insulating jacket of a cross-sectional shape which complements that of said passage and which, along said first length portion, makes a watertight interference fit with said passage.

7. In a d.c. - a.c. inverter circuit comprising a pair of d.c. input terminals for connection across a d.c. power source, a pair of a.c. output terminals for connection across a load, a transformer having a ferromagnetic core on which a primary winding, a first secondary winding and a second secondary winding are wound, and a bipolar transistor having its collector-emitter path connected in series with said primary winding across said d.c. input terminals and having its base-emitter path connected in parallel anti-polarity relationship with a diode, the improvement wherein:

said inverter circuit is arranged so that alternate half cycles of current flowing through a load connected to said a.c. output terminals is also caused to flow through said base-emitter path for automatically adjusting the forward base drive current of said transistor to compensate for changes in load current, there being provided for this purpose a connection of said first secondary winding, said second secondary winding and the parallel connection of said base-emitter path and diode in series with one another across said a.c. output terminals, said secondary windings being disposed in relation to said primary winding so that mutually aiding voltages are inductively developed in said secondary windings by voltage changes occurring in said primary winding.

8. The improvement according to claim 7, wherein a capacitor is provided between said second secondary winding and said load in the series connection across said load of said first secondary winding, said second secondary winding and said secondary parallel connection of said base-emitter path and diode.

9. The improvement according to claim 8, wherein a discharge current path for said capacitor is provided by way of said second secondary winding and a forward biasing resistor for said transistor when said a.c. output terminals are connected to said load.

10. The improvement according to claim 9, wherein said forward biasing resistor is connected in series with said first secondary winding and said parallel connection of said base-emitter path and diode.

11. The improvement according to claim 10, wherein a second forward biasing resistor for said transistor, together with said base-emitter path and a normally-open time-delay switch, are connected in series with one another across said d.c. input terminals, said time-delay switch being closed for the period of its time delay in response to a connection being made of said d.c. input terminals to said d.c. power source.

12. The improvement according to claim 11, for use with a fluorescent lamp of the preheat type as the load to which said a.c. output terminals are to be connected, wherein said time-delay switch is arranged, when closed and when said a.c. output terminals are connected to said lamp, to supply preheating current to at least one preheater of said lamp from said d.c. power source.

13. The improvement according to claim 11 or 12, wherein said time delay switch comprises a second bipolar transistor having one side of its base-emitter path connected to one of said d.c. input terminals and the other side connected by way of series R-C timing means to the other d.c. input terminal, said timing means having a time constant corresponding to the time delay of said switch and being arranged so that source-derived charging current for the capacitor thereof will flow through the resistor thereof and said base-emitter path of said second transistor to bias said second transistor ON until said capacitor becomes fully charged at the end of said time delay.

14. The improvement according to claim 13, wherein the capacitor of said R-C means is provided with a discharge circuit for draining away any residual charge remaining thereon when it becomes necessary to connect said d.c. input terminals to a fresh power source.

15. The improvement according to claim 14, wherein another capacitor is connected across the serially-connected primary winding and collector-emitter path of the first-mentioned transistor, and wherein part of said discharge circuit provided for the capacitor of said R-C timing means is arranged to drain away any residual charge remaining on said other capacitor when it becomes necessary to connect said d.c. input terminals to a fresh power source.

* * * * *